US007159351B2

(12) United States Patent
Sparkowski

(10) Patent No.: US 7,159,351 B2
(45) Date of Patent: Jan. 9, 2007

(54) DISPLAY KIOSK

(75) Inventor: Robert P. Sparkowski, Schaumburg, IL (US)

(73) Assignee: Chicago Display Martketing, River Grove, IL (US)

( * ) Notice: Subject to any disclaimer, the term of this patent is extended or adjusted under 35 U.S.C. 154(b) by 241 days.

(21) Appl. No.: 10/950,930

(22) Filed: Sep. 27, 2004

(65) Prior Publication Data

US 2006/0070284 A1 Apr. 6, 2006

(51) Int. Cl.
*G09F 15/00* (2006.01)

(52) U.S. Cl. ..... 40/610; 40/539

(58) Field of Classification Search ..... 40/610, 40/124.16, 539, 750, 606.18, 788, 789
See application file for complete search history.

(56) References Cited

U.S. PATENT DOCUMENTS

| | | | | |
|---|---|---|---|---|
| 2,449,911 | A * | 9/1948 | Roth | 40/539 |
| 3,727,874 | A | 4/1973 | Wuensch | |
| 4,235,032 | A * | 11/1980 | Robinson | 40/539 |
| 4,619,426 | A | 10/1986 | Drueck, Jr. | |
| 4,728,478 | A * | 3/1988 | Sacks et al. | 428/542.8 |
| 4,773,622 | A | 9/1988 | Herlin | |
| 4,854,060 | A | 8/1989 | Corbo et al. | |
| 5,351,882 | A * | 10/1994 | Krautsack | 206/45.26 |
| 5,467,547 | A | 11/1995 | Fortner | |
| 5,608,977 | A * | 3/1997 | Burtch et al. | 40/124.15 |
| 6,382,433 | B1 * | 5/2002 | Podergois | 211/195 |
| 6,508,023 | B1 | 1/2003 | Moss et al. | |
| 6,510,637 | B1 * | 1/2003 | DeLozada et al. | 40/788 |
| 2002/0104244 | A1 * | 8/2002 | Moss et al. | 40/610 |
| 2003/0145499 | A1 * | 8/2003 | Tarter et al. | 40/610 |

* cited by examiner

*Primary Examiner*—Robert J. Sandy
*Assistant Examiner*—Marcus Menezes
(74) *Attorney, Agent, or Firm*—Jansson, Shupe, Munger & Antaramian, Ltd.

(57) ABSTRACT

A kiosk includes a pair of displays each having a display panel hinged at opposed curved edges to a pair of side panels. The display panel has opposing reinforcing panels hinged thereto and connected to an inner surface of the display panel. Each side panel has two opposing side reinforcing panels hinged thereto and connected to an inner surface of each side panel. An elastic element extends between two laterally aligned apertures in one side panel and another side panel to keep them parallel. The one side panel has a series of aligned notches. The displays are in contiguous relation such that each elastic element engages one notch. A connection tab is hinged to each of the side panels and is moved to engage a connection area on an adjacent side panel to facilitate connection of displays.

20 Claims, 4 Drawing Sheets

DISPLAY KIOSK

BACKGROUND

The present disclosure relates to foldable structures for advertising displays, and more particularly, to such a structure formed of self-supporting sheet material which can be easily folded to form a compact package for storage and shipping and yet is easily assembled to provide a sturdy, self-supporting construction especially suited for display of advertising messages.

In so called "point of sale" advertising, where an advertising message is to be brought to the consumer in the shop or market where the advertised product is sold or services are provided, it is a regular practice of either the merchant or the supplier of the product or service to provide vivid, eye-catching displays closely adjacent to the supply of such products or services to attract the attention of the consumer. Generally, these displays are of the type that may be quickly set up and taken down by employees without special equipment or assistance.

One such class of advertising displays comprises advertising messages carried by a panel formed of paperboard, cardboard, or other similar self-supporting material which is held in a generally upright position by means such as an easel or a self-contained foldable support frame. The latter is particularly advantageous since it can be formed of the same material as the display panel, is generally lighter in weight and less bulky than separate supporting structures and is less expensive.

One such type of support frame consists of a sheet of paperboard which can be folded to form a channel of U-shaped cross section with the side panels of the channel being retained in that position by spacers and elastic bands. The frame and spacers may be flattened out and the frame folded to reduce its bulk for transporting. The display medium carried by the support frame comprises a plurality of separate panels secured to the reverse side of the support frame. Thus, when the side panels of the support frame are flattened, the frame may be folded in the longitudinal direction between the display panels to provide a package that is easily carried.

While such frames are portable and can be easily erected and collapsed, they still present certain drawbacks which detract from their utility and ability to present an advertising message of sufficient impact on potential consumers.

Another type of support frame includes flaps provided along a rear surface of the display panel. The flaps of the display panel. The flaps may be folded transversely to the panel to hold the display panel erect. However, the flaps have not been effectively utilized so as to contribute to the visual impact of the display, such flaps being limited to merely functioning as "legs" for the structure.

These prior art displays are unduly complex in design and manufacture and have structural weaknesses which limit the number of times they may be collapsed and erected without damage. Moreover, the construction of these displays requires that the advertising display be divided into completely separate panels with spaces therebetween, thereby limiting the format of the message carried by the the separate panels and detracting from the display's appearance and advertising impact.

Accordingly, there is a need in the art for a structure in which a continuous advertising display panel is supported in an upright position by a simple, sturdy support. There is a further need for a structure in which both the panel and support may be readily collapsed into a compact package and yet an additional need for a structure in which the structure is completely self-supporting in a reliable manner simply by unfolding it.

BRIEF DESCRIPTION OF THE DRAWINGS

Certain embodiments are shown in the drawings. However, it is to be understood that the present disclosure is not limited to the arrangements and instrumentalities shown in the attached drawings wherein.

DETAILED DESCRIPTION

Figure 1:
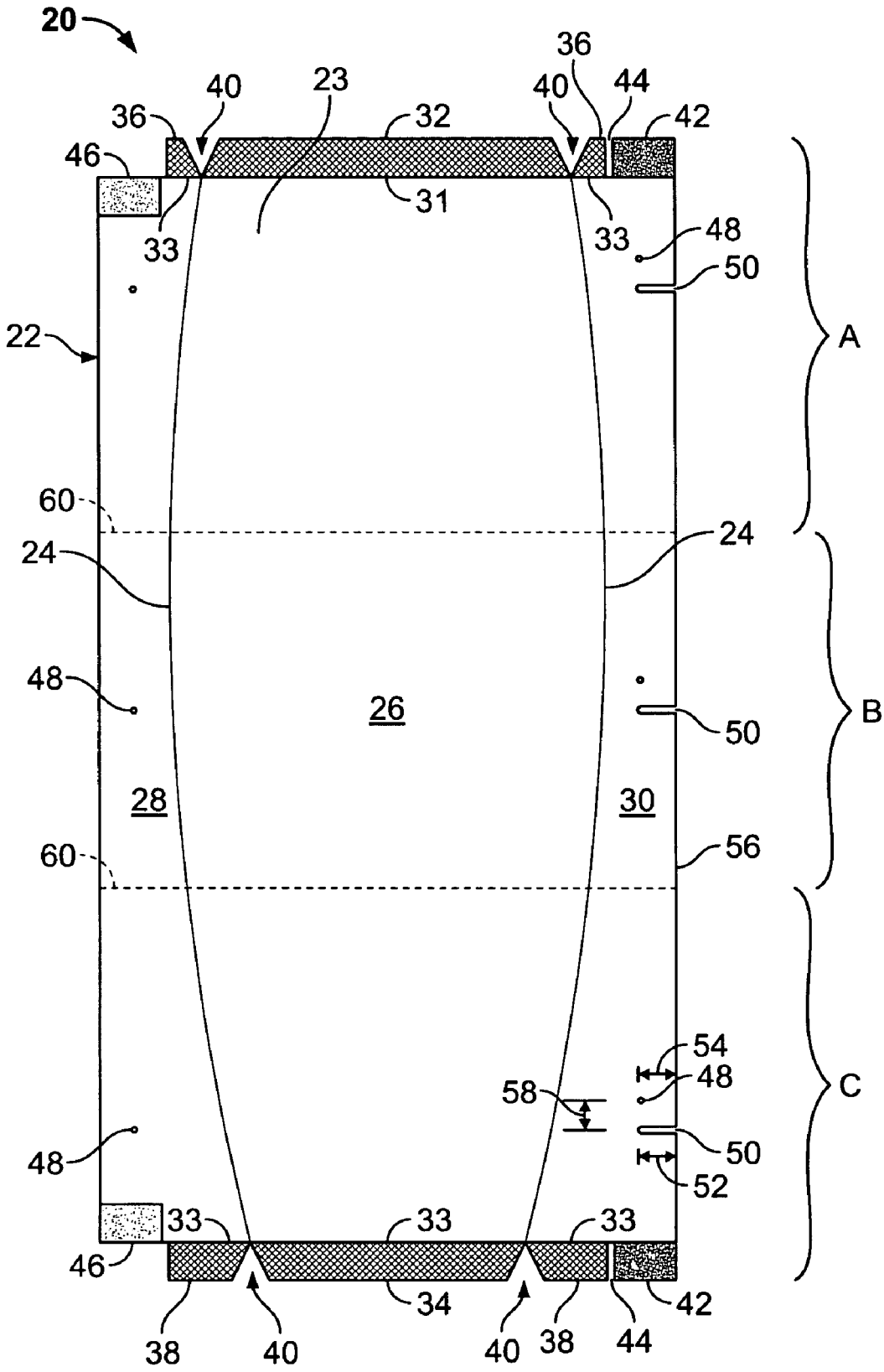
FIG. 1 illustrates a plan view of an inner surface of a blank for creating a display.

For the purpose of promoting an understanding of the principles disclosed herein, reference will now be made to the preferred embodiments illustrated in the drawings. While the preferred embodiments are described in terms of specific text, it is nevertheless to be understood that no limitation of the scope is thereby intended, such scope including those alterations and further modifications in the illustrated device and such further applications of the principles disclosed and illustrated herein being contemplated as would normally occur to one skilled in the art to which this disclosure relates.

In accordance with one principal aspect of the present disclosure, a blank for fabricating a display is provided. The blank is formed from a generally rectangular sheet of material and includes, among other things, a pair of longitudinal curved fold-forming creases forming a plurality of laterally offset sections. The sections are generally configured as a display panel hinged on each opposing side thereof to a side panel. The display panel includes a pair of opposing display reinforcing panels hinged to the display panel by fold-forming creases for movement relative to the display panel. Each side panel includes a pair of opposing side reinforcement panels hinged to the side panel by fold-forming creases for movement relative to each side panel. One of the side panels includes a pair of opposing connection tabs hinged to the one side panel by a fold-forming crease for movement relative to the one-side panel. An other of the side panels includes a pair of opposing connection areas defined thereon.

In another principal aspect of the present invention, a display is formed from a cut and creased blank of foldable sheet material that is stored and shipped in a folded configuration. In a set-up condition, the display includes, among other things, a display panel hinged at opposed longitudinal curved edges to a pair of side panels. The side panels are oriented generally parallel to the other. The display panel includes a pair of opposing display reinforcing panels hinged to the display panel and connected to an inner surface of the display panel. Each of the side panels includes a pair of opposing side reinforcing panels hinged thereto and connected to an inner surface of each side panel. An elastic element extends between a pair of generally laterally aligned apertures formed in one side panel and an other side panel for maintaining the side panels oriented generally parallel to the other when folded.

In yet another principal aspect of the present invention, a kiosk includes, among other things, a pair of displays. Each display includes a display panel hinged at opposed longitudinal curved edges to a pair of side panels oriented generally parallel to the other. The display panel includes a pair of opposing display reinforcing panels hinged to the display panel and connected to an inner surface of the display panel. Each of the side panels includes a pair of opposing side reinforcing panels hinged thereto and connected to an inner surface of each side panel. An elastic element extends between a pair of generally laterally aligned apertures formed in one side panel to an other side panel for maintaining the side panels oriented generally parallel to the other when folded. The one side panel includes a series of longitudinally aligned notches formed therein. The pair of display panels are disposed in contiguous relation such that each elastic element engages one of the notches and wherein a connection tab hingedly connected to each of the one side panels is moved to engage a connection area defined on a respectively immediately adjacent other side panel to facilitate connection of the displays to one another.

In all principal aspects of the present invention, indicia is preferably disposed individually or in combination on the display panels and/or side panels.

FIG. 1 illustrates a plan view of an inner surface of a blank 20 for creating a display which is formed from a generally rectangular sheet of foldable material 22. It will be recognized by those of skill in the art that the foldable material is suitable for a self-supporting structure and may be folded upon itself to reduce its dimensions for storage and shipping. Suitable foldable material may include paperboard, cardboard or any other suitable natural or synthetic sheet material which provides the structural and functional advantages described herein.

The blank 20 is divided by a pair of longitudinal curved fold-forming creases 24 into a plurality of laterally offset sections generally configured as a display panel 26 and side panels 28, 30 defined by laterally opposed longitudinal curved fold-forming creases 24. In one embodiment, the longitudinal curved fold-forming creases 24 are configured to provide an aesthetic and unique shape useful to catch the eye of consumers and blend well with other decor at a point of sale location. It will be recognized by those of skill in the art that the longitudinal curved fold-forming creases 24 are not limited as shown herein, but may have different configurations to provide a different look, appearance and connotation to consumers at the point of purchase. The longitudinal curved fold-forming creases 24 also define, in a set-up condition, opposing edges of the display panel 26 to which are hinged respective side panels 28, 30.

The display panel 26 includes a pair of opposing display reinforcing panels 32, 34 hinged to the display panel 26 by fold-forming creases 31, 33 for movement of the respective display reinforcing panels 32, 34 relative to the display panel 26. The display reinforcing panels 32, 34 each have structure or material disposed thereon to facilitate connection of the display reinforcing panels 32, 34 to the display panel 26. It will be recognized by those of skill in the art that such structure or material to facilitate connection may be any type of engagement fastener, adhesive, glue, tape, sticky material or other suitable structure or material known to perform such function.

Each side panel 28, 30 includes a pair of opposing side reinforcing panels 36, 38 hinged to the respective side panel 28, 30 by fold-forming creases 33 for movement relative to each respective side panel 28, 30. The side reinforcing panels 36, 38 each have structure or material disposed thereon to facilitate connection of the side reinforcing panels 36, 38 to the respective side panels 28, 30. It will be recognized by those of skill in the art that such structure or material to facilitate connection may be any type of engagement fastener, adhesive, glue, tape, sticky material or other suitable structure or material known to perform such function.

A relief 40 is provided between each display reinforcing panel 32, 34 and each immediately adjacent side panel reinforcing 36, 38 to prevent overlap of such reinforcing panels in the set up configuration of the display.

One of the side panels 30 includes a pair of opposing connection tabs 42 hinged to the one side panel 30 by a fold-forming crease 33 for movement relative to the one side panel 30. A gap 44 is defined between each connection tab 42 and a respectively adjacent side reinforcing panel 36, 38 such that the connection tabs 42 and the respectively adjacent side reinforcing panel 36, 38 may be moved independently about the fold-forming crease 33 to function as discussed in more detail below.

An other of the side panels 28 includes a pair of opposing connection areas 46 defined thereon. The connection tabs 42 and connection areas 46 each have complementary structure and/or materials useful to facilitate connection therebetween. Such structure and materials may be any mechanical fastener, such as complementary halves of a hook and loop fastener, adhesive, glue, or any other suitable structure material to facilitate connection. As shown in this embodiment, the connection tabs 42 are shaded to indicate one-half of a hook and loop fastener and the connection areas 46 are shaded to indicate a complementary half of a hook and loop fastener.

The blank 20 further includes a series of longitudinally aligned apertures 48 formed in the one side panel 30 and the other side panel 28. A series of longitudinally aligned notches 50 are formed in the one side panel 30 such that one of the notches is disposed adjacent each aperture 48. It will be recognized by those of skill in the art that each notch 50 has a depth 52 at least as great as the distance 54 the each aperture 48 is disposed from a longitudinal edge 56 of the blank 20. Further, the apertures 48 formed in the one side panel 30 are longitudinally offset (indicated by arrow 58) from the apertures 48 formed in the other side panel 28. Preferably, the offset 58 is kept to a minimum for the purposes and functions described hereinafter. However, the offset 58 in this FIG. 1 has been exaggerated for clarity. In another embodiment of the blank, each of the notches 50 formed in the one side panel 30 are laterally aligned with one of the apertures 48 formed on the other side panel 28.

In another embodiment, the blank 20 is further divided by at least one laterally fold-forming crease 60 into longitudinally offset sections A, B, and C to facilitate folding of the blank for storage and shipping. In another embodiment, indicia 62 is disposed, individually or in combination, on the display panel 26 or the side panels 28 or 30. The indicia 62 may be disposed on each of the display panel 26 and the side panels 28, 30, the display panel 26 and one of the side panels 26 or 30 or just the display panel 26. It will be recognized by those of skill in the art that the indicia 62 will be configured to meet the design parameters and objectives set out by the users of the display to generate interest when disposed in a point of sale location.

Figure 2:
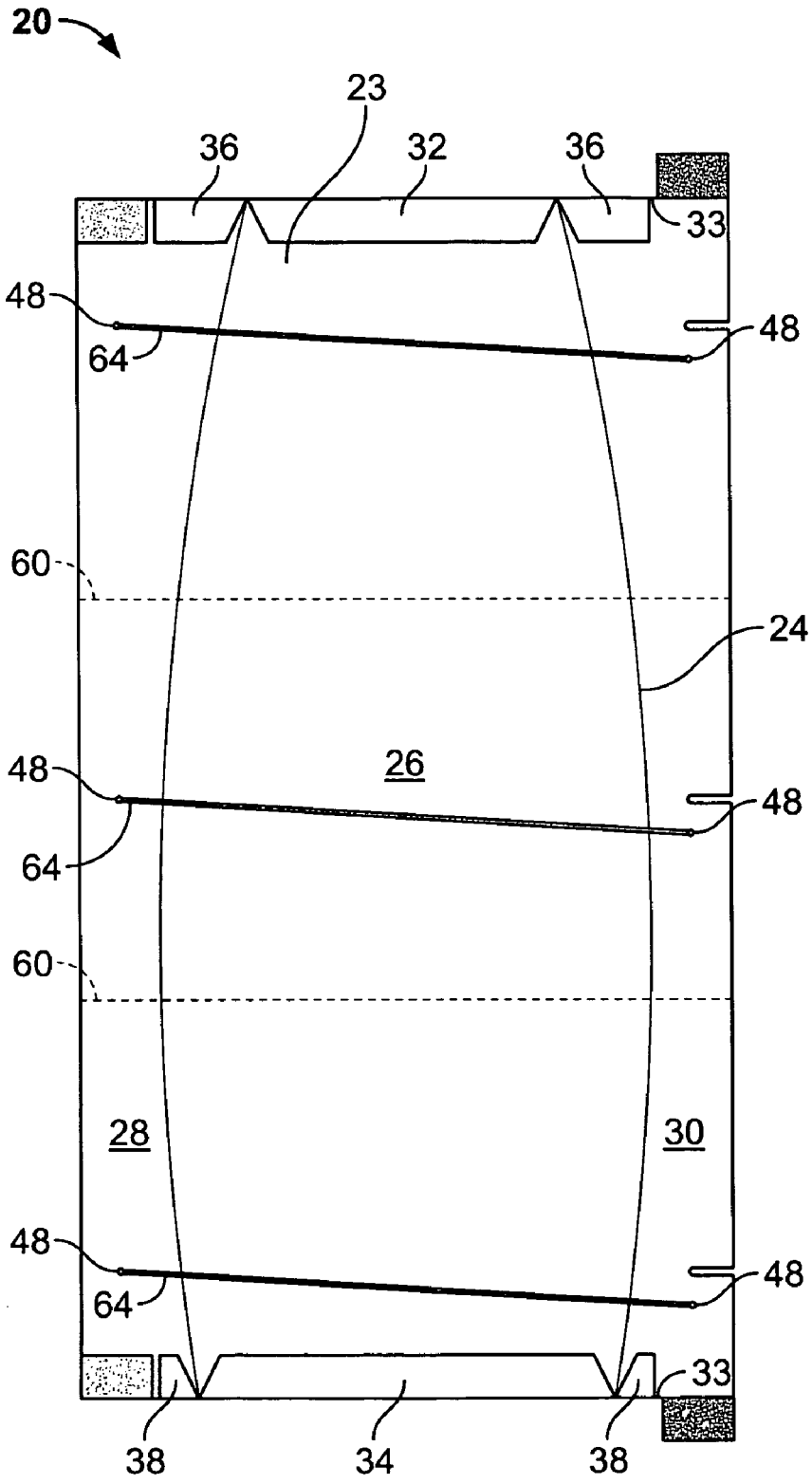
FIG. 2 illustrates a plan view of the blank of FIG. 1 prepared for configuration as the display.

FIG. 2 illustrates the blank 20 partially assembled to create a display formed from a cut and creased blank of foldable sheet material that may be stored and shipped in a folded configuration. The display reinforcing panels 32, 34 and the side reinforcing panels 36, 38 have been folded about the fold-forming crease 33 for connection to an inner surface 23 of the blank 20 in any suitable manner set forth above. Also illustrated in this embodiment are a plurality of elastic elements 64 which extend between a pair of generally laterally aligned apertures 48 formed in the one side panel 30 and the other side panel 28 both hinged to the display panel 26 at opposed longitudinal curved edges 24.

Figure 3:
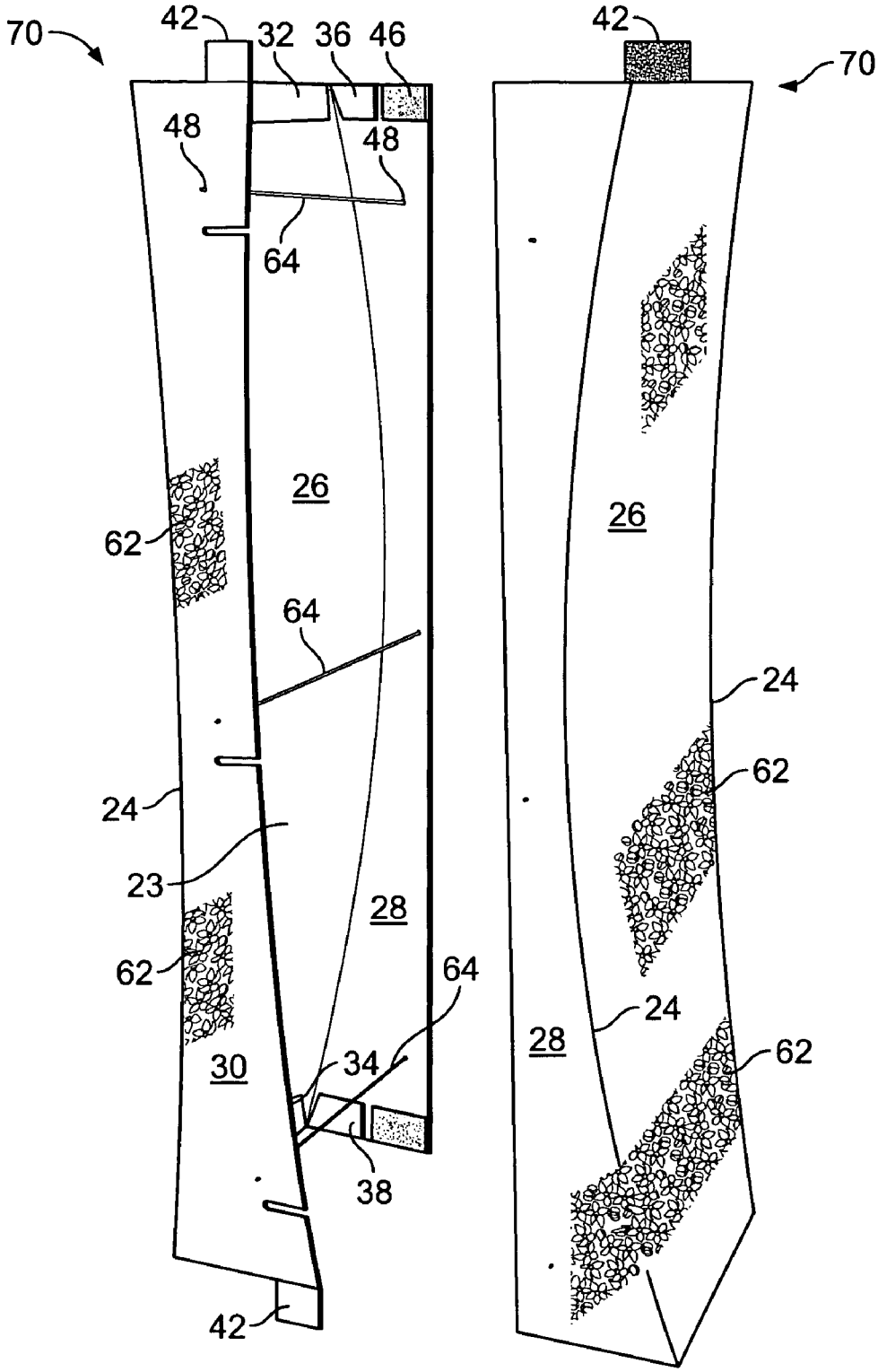
FIG. 3 illustrates a perspective view of a pair of displays configured in a set up condition.

FIG. 3 illustrates a pair of displays 70 formed from the cut and creased blank of foldable sheet material, each of the displays 70 includes, in a set up condition, among other things, a display panel 26 hinged at opposed longitudinally curved edges 24 to a pair of side panels 28, 30 oriented generally parallel. The display panel 26 includes a pair of display reinforcing panels 32, 34 hinged to the display panel 26 and connected to an inner surface 23 of the display panel 26. Each of the side panels 28, 30 includes a pair of opposing side reinforcing panels 36, 38 (only the reinforcing panels on side panel 28 are viewable in this FIG. 3, however, each of the displays 70 in this embodiment incorporate all such reinforcing panels described above). The elastic element 64 which extends between a pair of generally laterally aligned apertures 48 formed in the one side panel 30 and the other side panel 28 maintain the side panels 28, 30 oriented generally parallel in a set-up condition. It will be recognized by one of skill in the art that the elastic elements 62 may be retained in position by a simple knot in the end of the elastic element 64 or any other suitable mechanical interface therewith to prevent pull-through with respect to the aperture 48.

The one side panel 30 includes a pair of opposing connection tabs 42 hinged thereto. Such connection tabs 42 will be moved into contact with the connection areas 46 to facilitate connection of the pair of displays 70 to one another. As shown in this embodiment, the indicia 62 may be provided on the display panel 26, the display panel 26 and one of the side panels 28, 30 or the display panel 26 and each of the side panels 28, 30 as discussed above.

Figure 4:
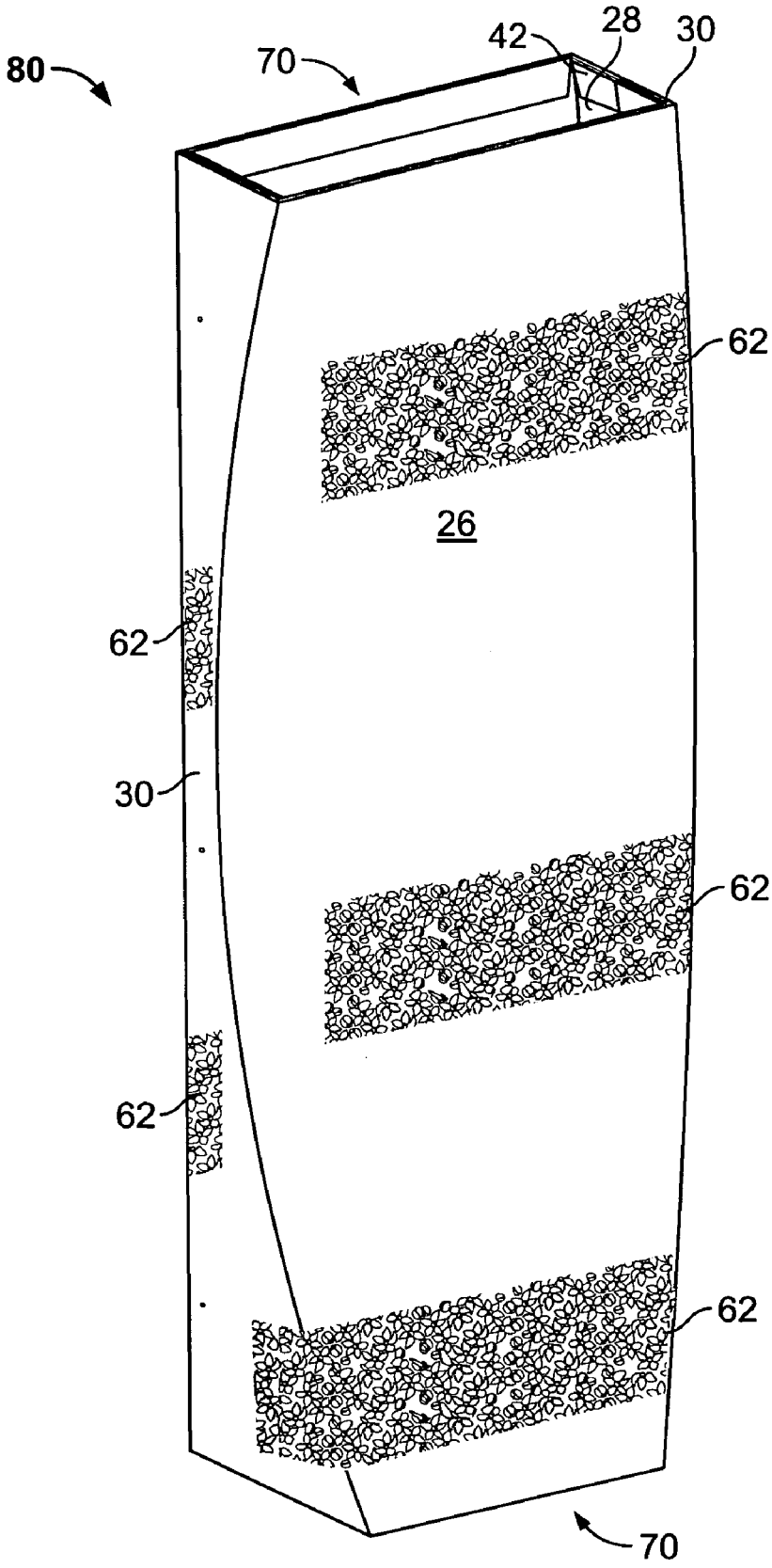
FIG. 4 illustrates a perspective view of a kiosk.

FIG. 4 illustrates a perspective view of a kiosk 80 which includes a pair of displays 70, described in detail above, disposed in contiguous relation such that each elastic element 64 engages one of the notches 50 and wherein a connection tab 42 hingedly connected to each of the one side panels 30 is moved to engage a connection area defined on a respectively immediately adjacent other side panel 28 to facilitate connection of the displays 70 to one another. The other side panel 28 of each display 70 is disposed interiorly to the one side panel 30 of each display immediately adjacent thereto. As described in more detail above, indicia 62 may be disposed on the display panel 26, the display panel 26 and one of the side panels 28, 30 or the display panel 26 and each of the side panels 28, 30 as discussed above.

Furthermore, while the particular preferred embodiments have been shown and described, it will be obvious to those of skill in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the related art.

What is claimed is:

1. A blank for fabricating a display which is formed from a generally rectangular sheet of material comprising:

the blank divided by a pair of longitudinal curved fold-forming creases into a plurality of laterally offset sections;

the sections generally configured as a display panel hinged on each opposing edge thereof to a side panel;

the display panel including a pair of opposing display reinforcing panels hinged to the display panel by fold-forming creases for movement relative to the display panel;

each side panel including a pair of opposing side reinforcing panels hinged to the side panel by fold-forming creases for movement relative to each side panel;

one of the side panels including a pair of opposing connection tabs hinged to the one side panel by a fold-forming crease for movement relative to the one side panel; and an other of the side panels including a pair of opposing connection areas defined thereon.

2. The blank as recited in claim 1, further including a series of longitudinally aligned apertures formed in the one side panel.

3. The blank as recited in claim 1, further including a series of longitudinally aligned apertures formed in the other side panel.

4. The blank as recited in claim 3, further including a series of longitudinally aligned notches formed in the one side panel wherein one of the notches is disposed adjacent each aperture.

5. The blank as recited in claim 2, further including a series of longitudinally aligned apertures formed in the other side panel.

6. The blank as recited in claim 5, wherein the apertures formed in the one side panel are longitudinally offset from the apertures formed in the other side panel.

7. The blank as recited in claim 6, further including a series of longitudinally aligned notches formed in the one side panel wherein each of the notches is disposed adjacent one of the apertures formed in the one side panel and laterally aligned with one of the apertures formed in the other side panel.

8. The blank as recited in claim 1, wherein the blank is further divided by at least one lateral fold-forming crease into longitudinally offset sections to facilitate folding of the blank when stored or shipped.

9. The blank as recited in claim 1, wherein indicia is disposed on the display panel or the side panels.

10. The blank as recited in claim 1, wherein indicia is disposed on the display panel and the side panels.

11. A display formed from a cut and creased blank of foldable sheet material that is stored and shipped in a folded configuration, the display comprising, in a set-up condition:

a display panel hinged at opposed longitudinal curved edges to a pair of side panels oriented generally parallel;

the display panel including a pair of opposing display reinforcing panels hinged to the display panel and connected to an inner surface of the display panel;

each of the side panels including a pair of opposing side reinforcing panels hinged thereto and connected to an inner surface of each side panel; and an elastic element extending between a pair of generally laterally aligned apertures formed in a one side panel and an other side panel for maintaining the side panels oriented generally parallel.

12. The display as recited in claim 11, further including the one side panel having a pair of opposing connection tabs hinged thereto.

13. The display as recited in claim 11, further including a series of longitudinally aligned notches formed in the one side panel.

14. The display as recited in claim 11, further including a pair of opposing connection areas defined in the other side panel.

15. The display as recited in claim 11, wherein indicia are disposed on the display panel or the side panels.

16. The display as recited in claim 11, wherein indicia are disposed on the display panel and the side panels.

17. A kiosk comprising:

a pair of displays each including a display panel hinged at opposed longitudinal curved edges to a pair of side panels oriented generally parallel;

the display panel including a pair of opposing display reinforcing panels hinged to the display panel and connected to an inner surface of the display panel;

each of the side panels including a pair of opposing side reinforcing panels hinged thereto and connected to an inner surface of each side panel; and an elastic element extending between a pair of generally laterally aligned apertures formed in a one side panel and an other side panel for maintaining the side panels oriented generally parallel;

the one side panel including a series of longitudinally aligned notches formed therein;

the pair of displays disposed in contiguous relation such that each elastic element engages one of the notches and wherein a connection tab hingedly connected to each of the one side panels is moved to engage a connection area defined on a respectively immediately adjacent other side panel to facilitate connection of the displays to one another.

18. The kiosk as recited in claim 17, wherein the connection tabs and connection areas cooperatively define a hook and loop fastener.

19. The kiosk as recited in claim 17, wherein the other side panel of each display is disposed interiorly to the one side panel of each display immediately adjacent thereto.

20. The kiosk as recited in claim 17, wherein indicia is disposed on the display panel and one of the side panels of each display.

* * * * *